US009950487B2

(12) United States Patent
Spiesshofer

(10) Patent No.: US 9,950,487 B2
(45) Date of Patent: Apr. 24, 2018

(54) METHOD FOR OPERATING A MACHINE TOOL OR A PRODUCTION MACHINE, AND USING THE MACHINE TOOL OR PRODUCTION MACHINE WITH A CONNECTING ARRANGEMENT FOR A LIFTING ELEMENT

(71) Applicant: SCHULER PRESSEN GMBH, Goeppingen (DE)

(72) Inventor: Thomas Spiesshofer, Bermatingen (DE)

(73) Assignee: SCHULER PRESSEN GMBH, Goeppingen (DE)

( * ) Notice: Subject to any disclaimer, the term of this patent is extended or adjusted under 35 U.S.C. 154(b) by 1252 days.

(21) Appl. No.: 14/032,201

(22) Filed: Sep. 20, 2013

(65) Prior Publication Data

US 2014/0083312 A1 Mar. 27, 2014

(30) Foreign Application Priority Data

Sep. 21, 2012 (DE) ..... 10 2012 108 933

(51) Int. Cl.
*B30B 1/28* (2006.01)
*B30B 15/14* (2006.01)
*B30B 15/00* (2006.01)

(52) U.S. Cl.
CPC ..... *B30B 1/28* (2013.01); *B30B 15/0064* (2013.01); *B30B 15/14* (2013.01)

(58) Field of Classification Search
CPC ..... B30B 1/28; B30B 15/14; B30B 15/165; B30B 15/0035; B30B 15/0064; B30B 15/0094
(Continued)

(56) References Cited

U.S. PATENT DOCUMENTS 4,103,611 A * 8/1978 Carlsson ..... B30B 15/18 100/257
5,243,902 A * 9/1993 Plazenet ..... B21D 5/0272 100/258 A
(Continued)

FOREIGN PATENT DOCUMENTS

AT 008 633 U1 10/2006
DE 41 18 569 A1 12/1992
(Continued)

*Primary Examiner* — Jimmy T Nguyen
(74) *Attorney, Agent, or Firm* — Norman B. Thot

(57) ABSTRACT

A method for operating a machine tool/work machine includes providing a machine tool/work tool including a stroke element, a connection arrangement including a traction/pressure element and at least one traction/pressure point, a detachable connection including a connection element, a compensation element or a unit which generate a pre-stress, a (cutting) impact dampening, and compensates for a weight of the stroke element in the connection arrangement. The drive device acts on a work piece to be machined via the connection arrangement with the traction/pressure element and the at least one traction/pressure point via the stroke element. A force is produced via the compensation element or a unit corresponding to a weight of the traction/pressure element, the force being initiated independently from a drive force for the stroke element, to generate a pre-stress, a (cutting) impact dampening and a compensation of the weight of the stroke element in the connection arrangement.

9 Claims, 2 Drawing Sheets

(58) Field of Classification Search
USPC ..... 100/269.01, 269.11, 269.13, 280, 281, 100/282, 35, 43
See application file for complete search history.

(56) References Cited

U.S. PATENT DOCUMENTS

| | | | | |
|---|---|---|---|---|
| 5,761,971 | A | 6/1998 | Brewer et al. | |
| 6,170,392 | B1 * | 1/2001 | Watercutter | B30B 1/28 100/264 |
| 2010/0206187 | A1 * | 8/2010 | Hafner | B30B 1/06 100/257 |
| 2013/0151002 | A1 * | 6/2013 | Spiesshofer | B30B 1/266 700/206 |

FOREIGN PATENT DOCUMENTS

| | | | |
|---|---|---|---|
| DE | 197 06 656 | A1 | 11/1997 |
| DE | 10 2007 030 772 | A1 | 1/2009 |
| DE | 10 2009 055 739 | A1 | 6/2011 |
| DE | 10 2011 016 669 | A1 | 10/2012 |
| WO | WO 2010/072208 | A2 | 7/2010 |

* cited by examiner

METHOD FOR OPERATING A MACHINE TOOL OR A PRODUCTION MACHINE, AND USING THE MACHINE TOOL OR PRODUCTION MACHINE WITH A CONNECTING ARRANGEMENT FOR A LIFTING ELEMENT

CROSS REFERENCE TO PRIOR APPLICATIONS

Priority is claimed to German Patent Application No. DE 10 2012 108 933.7, filed Sep. 21, 2012. The entire disclosure of said application is incorporated by reference herein.

FIELD

The present invention relates to a method for operating a machine tool or work machine and to a machine tool or work machine, implementable as a press with a bottom drive, with a connection arrangement for a stroke element transmitting a force in an alternating direction, which in a press acts as a so-called plunger with a tool on a work piece to be machined.

BACKGROUND

The present invention is mainly intended for a tie rod connection on a plunger of a press, in which the plunger is driven for its respective stroke by a drive device by way of tie rods (also in combination with a connecting rod) and the tie rods are detachably connected to the plunger.

As defined by the present invention, the connection arrangement and its use are, however, also applicable to any machine tool such as work machines with stroke elements transmitting a force in an alternating direction in which occurring load changes particularly affect the connection arrangement.

Such machine tools or work machines can be designed as presses, punching presses, guillotine shears, scrap shears, etc.

Connection assemblies must be understood as machine elements which are exposed to load changes due to the stroke and which detachably or permanently connect the machine elements transmitting the force from the drive device to the stroke element, such as, for example, the plunger.

The present invention is aimed at a generic machine tool or work machine such as a press with a bottom drive, which includes:

a) at least one machine table with a tool receiving area for at least one bottom tool and at least one plunger (stroke element) with a tool receiving area for at least one upper tool, disposed above the machine table, b) a drive device disposed in a sub-structure, which moves the plunger (stroke element) toward the machine table, c) at least one connecting rod (traction/pressure element or tie rod) coupled to the plunger, which is directly or indirectly coupled to the plunger (stroke element), d) at least one crank shaft rotatable about a shaft axis to which the connecting rod (traction/pressure element or tie rod) is coupled, e) at least one motor or servomotor of the drive device, and f) a connection arrangement between the connecting rod (traction/pressure element or tie rod) and the plunger (stroke element) by way of at least one traction/pressure point.

Among the complex machine functions acting in this type of machine, the connection arrangement between the connecting rod (traction/pressure element or tie rod) and the plunger (stroke element) via the traction/pressure point presents particularities, as a functional group, which are highlighted and examined below.

DE 10 2011 016 669 A1 describes a press with a bottom drive connecting the drive-transmitting tie rods with the plunger, respectively, by means of a previously mentioned connection arrangement consisting of a screw and nut at a traction/pressure point of the plunger.

Implementing a tie rod connection with at least one tie rod, mounted at, respectively, one traction/pressure point of the plunger, with a thread located on one tie rod part and a nut, which is rotatable mounted in the plunger and is drivable by means of gears, has additionally already been proposed.

During normal operation of a press, the drive elements as well as the tie rods are exposed to a changing application of force, more specifically, due to the functions related to the load change caused by the strokes of the plunger, such as the reversals occurring between machining strokes and idle strokes.

During a machining stroke with a forming process, for example, the tie rods thus pull on a nut, wherein the lower thread flanks on the tie rod are then loaded. In contrast, during the idle stroke with an upward stroke of the plunger, the plunger rests with the force of its mass on the upper flank of the thread of the tide rod.

Due to the load changes occurring in the thread with each stroke of the plunger, these changes have a disadvantageous effect on the durability at least of the force transmitting elements but also on the noise behavior of the press.

These problems in general have a disruptive impact on any connection arrangement on a stroke element transmitting an original force in an alternating direction in a machine tool or work machine such as a press with a bottom drive. The main disadvantage is wear due to load changes on the involved machine elements.

Several concrete solutions are known to solve these type of problems.

DE 102007030772 A1 describes a plunger connecting device free of load changes in a press with an adjustment device which is pre-stressed, for example, by a hydraulic pre-stressing device with a force that is greater than the force to be transmitted by the adjustment device.

This is based on the fact that a change of sign of the load direction can occur in such adjustment devices during the back-and-forth movement of the plunger which has the following characteristics: in a bulk press, for example, with a plunger adapted to be moved vertically up and down, the load of the plunger and of the upper tool part normally hangs on the connecting rod and in addition on a so-called weight compensation device (SGA). During forming of the work piece, the connecting rods moving the plunger transmit a compressive force onto the plunger. Prior to that and after that they transmit a tensile force.

This load change leads to wear on the adjustment device which connects the connecting rod and the plunger (connection arrangement), wherein the threads available there are more specifically jeopardized.

This improved bulk press, in particular, with a plunger that is connected to a drive device by way of at least one connecting rod, comprises a pre-stressing device which is attached to one of the said adjustment devices and which avoids load changes on the adjustment device.

Any clearance in the area of the adjustment device is thus to be eliminated. Since there is no reversal of the direction of the load, but rather a dynamically increasing load, the durability of the elements engaged with each other is increased. The size of the thread of the adjustment nut and the adjusting spindle in the thread connection of the adjustment device can be chosen correspondingly smaller while having the same durability.

The remaining design consists in:

- the thread connection having a first thread element that is connected to the connecting rod and a second thread element that is connected to the plunger and the pre-stressing device stressing the first thread element against the second thread element,
- both thread elements being disposed concentrically to a force transmission direction,
- the thread elements being pre-stressed against each other in the direction of the force transmission,
- the pre-stressing device generating a force which is bigger than the greatest expected force to be transmitted by the connecting rod to the plunger during normal operation of the press,
- the pre-stressing device generating a force acting between a thread element of the adjustment device that is connected to the connecting rod and the plunger,
- the pre-stressing device having a piston that is adapted to be hydraulically loaded and rests on one of the thread elements in the axial direction, the piston being non-rotatably connected to the other of the thread elements or the adjustment device,
- a rotary drive device being attached to the adjustment device, and
- the pre-stressing device having an overload safety device or is connected to one.

From this solution, the person skilled in the art learns, with regard to the functional group of a connection arrangement highlighted above, a pre-stressing device that is meant to avoid load changes on the adjustment device. The force to be applied for pre-stressing must, however, correspond to the pressing force which requires energetically as well as structurally complex solutions.

DE 000019706656 A1 describes a mechanical press comprising a frame, a bed fastened to the frame, a plunger referred to as a slide, which is connected to the frame in order to implement a back and forth movement relative to the bed. The plunger is driven by a crank shaft via a connecting rod. The plunger and the bed define the shut height of the press when the plunger is at the bottom dead center.

In accordance with the object, the shut height must be precisely and reproducibly adjusted.

A drive unit with a drive piston and tie rod and a shut height adjusting device with a chamber are provided for driving the plunger.

The shut height adjusting device comprises a pressure source which is in conductive connection with the chamber. By loading the chamber with a medium from the pressure source, the tie rod is lengthened or shortened for adjusting the shut height.

This solution teaches loading the chamber with a medium from a pressure source for adjusting the shut height in order to lengthen or shorten the tie rod (traction/pressure element), but without a pre-stressing function.

DE 41 18 569 describes a so-called hydraulic pressure point between a connecting rod and a plunger of a press for cutting, deep drawing or embossing. This pressure point can also be disposed between the table and the frame of a press or between other parts of a machine in a force flow. The present invention serves to prevent overturning, for cutting impact dampening or/and as overload protection and can be used as part of a force measuring system. To this end, two telescopic piston/cylinder assemblies are disposed in the force flow. These assemblies enclose two pressure chambers and are stressed against each other by the pre-stressing pressure in the chambers against a spring. A hydraulic switch between the pressure source and one of the chambers comprises a continuous valve, the difference between the actual pressure in the other chamber and its pre-stressing pressure being applied to its control input, said pre-stressing pressure corresponding to a positive difference between the actual pressure and the pre-stressing pressure of the control chamber and to an increase in pressure in the controlled chamber.

The person skilled in the art learns therefrom that a cutting impact dampening on the one hand and a pre-stressing pressure on the other hand is to be generated by way of a hydraulic switch, wherein, in terms of construction, no functional connection between cutting impact dampening and pre-stressing pressure, with regard to the hydraulic pressure point between the connecting rod and the plunger, is taught.

AT 008 633 U1 describes the following:

Hydraulic presses have a hydraulic cylinder between the table and the plunger moving relative to it. This simple hydraulic drive unit must nonetheless fulfill high safety requirements. As a solution, an energy store is provided, the stored energy of which is sufficient to generate a restoring force, which acts against the weight of the plunger and is greater than said weight. The weight of the plunger is thereby compensated for.

This simple press is not usable as a generic press as described above; it merely teaches the measure of applying a force that is greater than the weight of the plunger, which is well-known to developers of large presses.

WO 2010/072208 A2 describes a method for operating a forming machine or a forming unit with at least one plunger disposed on a shaft via an articulation. Hereby:

- at least one rotary drive acting intermittently on the shaft provides a required forming energy to the plunger, and
- at least one direct drive acting intermittently on the plunger allows for a defined movement of the plunger.

The gravitational acceleration which effectively acts on the plunger is thereby adapted by way of the direct drive.

This method is characterized in that:

- another direct drive, for example, a servo-motor, acting at least intermittently on the plunger allows for a defined periodic movement of the plunger,
- the plunger experiences, by way of the direct drive, a counterforce reducing the gravitational acceleration in an upper stroke range,
- the direct drive has a hydraulic or pneumatic configuration,
- at a predetermined gravitational acceleration, the plunger engages with the rotary drive, for example, in the lower stroke range, or disengages from the rotary drive, for example, in the lower stroke range,
- the plunger weight compensation device (SGA) is used as the direct drive adapting the gravitational acceleration,
- the plunger performs an accelerated falling movement in an upper stroke range, the falling movement is influenced, for example, slowed down, by a force generated by the plunger weight compensation device, the rotary drive is engaged with the shaft at a time of a defined fall velocity synchronized with the speed of the rotary drive, the engaging process occurring, for example, in the lower stroke range, more specifically, shortly before forming, and the rotary drive being disengaged in the lower stroke range (shortly after forming) at a synchronized plunger velocity, and the dwell time of the plunger in the lower stroke range being reduced by a factor of at least 1:2 compared to the dwell time in the upper stroke range.

Aside from the fact that this method does not address the connection arrangement defined in the introduction, it teaches that the direct drive adapting the gravitational acceleration uses the so-called plunger weight compensation device (SGA).

DE 10 2009 055 739 A1 describes the forming machine (also with a bottom drive) as a quasi-generic press.

DE 10 2009 055 739 A1 describes that the high forces occurring during pressing processes, which put a strong strain on the mechanical components and therefore limiting the efficiency, shall be acceptable for the press and a more simple construction should be provided.

This press comprises:

At least one machine table with a tool receiving area for at least one lower forming tool and at least one plunger with a tool receiving area for at least one upper forming tool, the plunger being disposed above the machine table and movable by means of a drive device relative to the machine table.

A drive device for the plunger with several connecting rods which are directly or indirectly coupled to the plunger in an upper connecting rod bearing.

At least one crankshaft that is rotatable about a shaft axis and to which at least one connecting rod is coupled in a lower connecting rod bearing.

At least one servo-motor for driving the crank shaft, each crank shaft and the lower connecting rod bearing of the connecting rods being disposed under the tool receiving area of the machine table and the upper connecting rod bearing of the connecting rod being disposed above the tool receiving area of the machine table and/or above the tool receptacle of the plunger.

From the press of the type defined above, the person skilled in the art cannot learn any characteristics regarding the functional group of a connection arrangement of the connecting rod (traction/pressure element or tie rod) with the plunger (stroke element) via the traction/pressure point.

If the person skilled in the art examines, after this analysis of the prior art, the functional configuration and interrelationship of a pressure or traction point of a machine tool such as a large press with regard to the functional group of a connection arrangement of the connecting rod (traction/pressure element or tie rod) with the plunger (stroke element) via the traction/pressure point, they would discover that:

1. In forming presses with a bottom drive and linear movements of the plunger, different forces occurring during a plunger stroke are inevitable with regard to amount as well as direction for the continuous operation of the machine. During the downward movement, the work piece is essentially formed and thus presses against the plunger, whereas during the upward movement, the plunger is moved in the opposite direction and a force change occurs in individual components due to gravity.
2. On the other hand, in presses with a top drive, the weight is, as a rule, increasingly compensated for during the downward movement of the plunger by a corresponding arrangement of one or several pneumatic cylinders, so that all the components located in the force flow are already more or less pre-stressed before the actual forming process and a distinct and significant increase of the force occurs at the beginning and during forming, but without the force being changed in terms of direction.
3. The arrangement of the aforementioned plunger weight compensation device (SGA) serves to compensate for the weight of the plunger. In order to compensate for the weight of the plunger, it is well-known to install pneumatically pre-stressed cylinders between the frame of the press and the plunger, so that the weight of the plunger is absorbed by the cylinders of the SGA and the drive is not accelerated by the weight of the plunger during the downward movement. In return, the upward movement is not slowed down since the pressure in the cylinders of the SGA is adjusted so that it corresponds approximately to the weight of the plunger. A disadvantage is that the mass of the plunger, i.e., the weight caused by its speed, cannot be compensated for.
4. A relatively "soft" touchdown of the plunger on the component to be formed and on the counter-tool lying below it is thus always advantageous during operation of the press, an operation preserving the machine and the components being thus given. An abrupt force change can occur specifically during cutting operations, namely, when cutting through the piece to be cut, the entire machine thus unloading abruptly (the so-called cutting impact). In order to technically master this problem, there are extensive technical solutions which are known under the technical term "cutting impact dampening". Said traction/pressure points are also designed so that they are pre-stressed, so that the adjustment within the traction/pressure point, which is required for the adjustment of the plunger and is implemented as a rule via a thread system, does not experience a change in force direction during these cutting impacts and the traction points have a longer durability.
5. In generic machines, the problem of an energetically and structurally advantageous use of a force that corresponds to the weight of the plunger, remains widely unsolved for the characteristics of a functional group of a connection arrangement of the connecting rod (traction/pressure element or tie rod) with the plunger (stroke element) via the traction/pressure point.

SUMMARY

An aspect of the present invention is to provide a method for operating a machine tool or work machine, and a machine tool or work machine with a bottom drive, more specifically, a press with at least one connection arrangement, which transmits an original force in an alternating direction in a traction/pressure point of a stroke element such as a plunger, and has a traction/pressure element between the connecting rod (traction/pressure element or tie rod) and the plunger (stroke element) via the traction/pressure point as a functional group, wherein:

a force that corresponds to the weight of the plunger is to be introduced into the operation of the connection arrangement, the durability of force-transmitting elements is increased and the noise is reduced, and the occurring load changes inside the directly-involved machine elements do not lead to an increased stress due to shocks and have a negative effect on the service life of the components and ultimately of the machine.

In an embodiment, the present invention provides a method for operating a machine tool or a work machine which includes providing a machine tool or a work tool comprising a stroke element, a connection arrangement comprising a traction/pressure element and at least one traction/pressure point, a detachable connection comprising a connection element, a compensation element or a unit configured to generate a pre-stress, a (cutting) impact dampening, and to compensate for a weight of the stroke element in the connection arrangement, and a sub-structure comprising a drive device configured as a bottom drive. The drive device is configured to act directly or indirectly on a work piece to be machined via the connection arrangement with the traction/pressure element and the at least one traction/pressure point via the stroke element. A force is produced via the compensation element or a unit corresponding to a weight of the traction/pressure element, the force being initiated independently from a drive force for the stroke element, so as to generate a pre-stress, a (cutting) impact dampening and a compensation of the weight of the stroke element in the connection arrangement.

BRIEF DESCRIPTION OF THE DRAWINGS

The present invention is described in greater detail below on the basis of embodiments and of the drawings in which.

DETAILED DESCRIPTION

Figure 1:
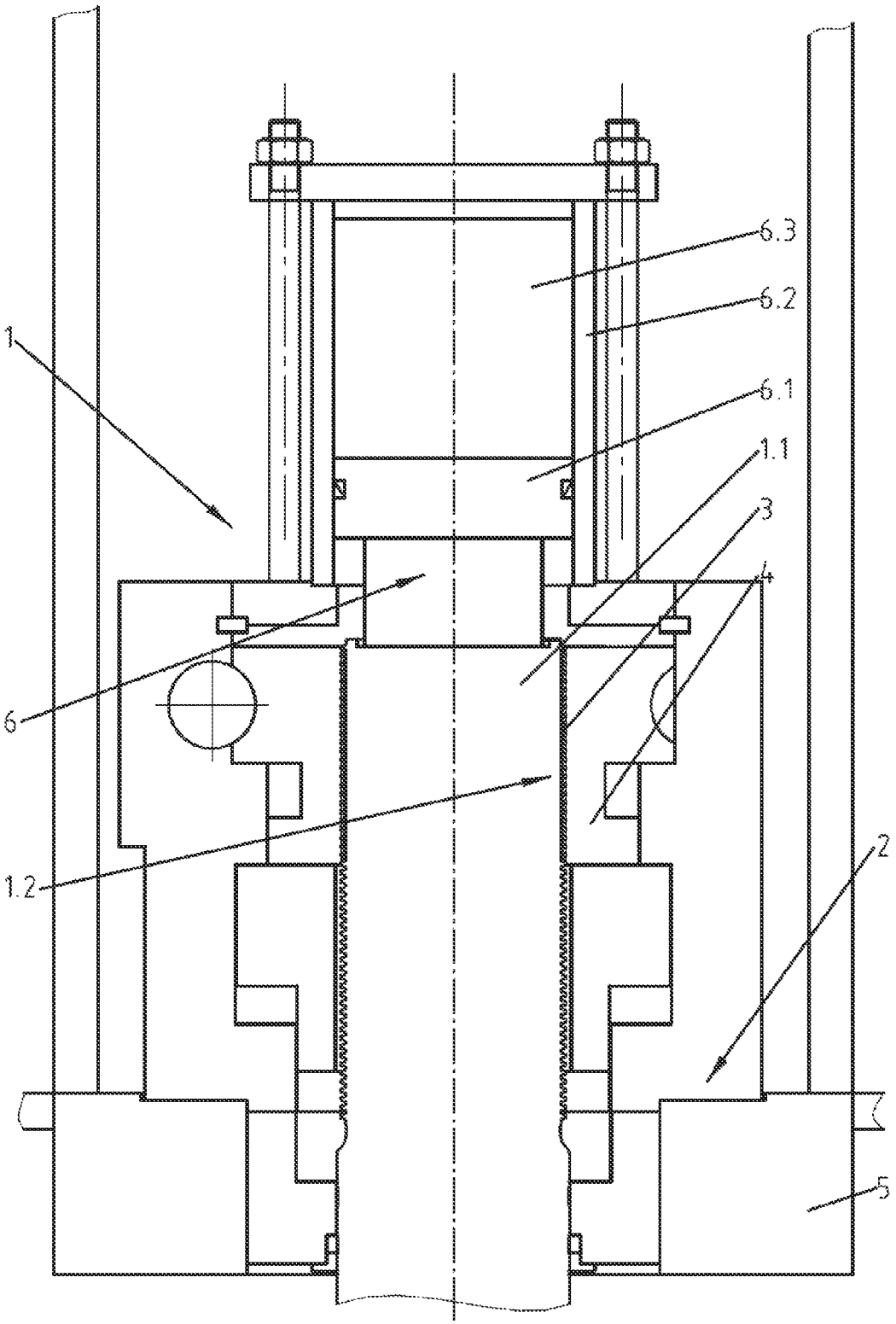
FIG. 1 shows a connection arrangement 1 according to the present invention on the plunger 5 of the press acting in an alternating direction with the unit 6 compensating for the weight of the plunger 5.

In an embodiment of the present invention, it is first provided to intervene in a customary operating procedure of the machine tool or work machine as follows:

In a generic machine tool or work machine, a pre-stressing and a (cutting) impact dampening as well as a compensation of the weight of the stroke element is generated in the connection arrangement comprising the traction/pressure element, the traction/pressure point and a detachable connection with a connection element, by a force, which is induced independently from a drive force for a stroke element by means of a compensation element or a unit and corresponds to the weight of the traction/pressure element.

It is known that the respective force acting independently of the original drive force for the stroke element can be greater than the weight of the stroke element.

In an embodiment of the present invention, a pre-stress and a (cutting) impact dampening can be generated solely by means of the unit in the traction/pressure point and of the detachable connection, such as a thread, with the connection element, such as the rotary nut, of the connection arrangement. This provides that there is a pre-stress in the thread that connects the traction/pressure element to the connection element, so that, during the operation of the press, for example, there is no change in the direction of the force in that thread which would be disadvantageous for the durability of the thread. The pre-stress of the thread thus provided also provides an impact dampening with regard to the stress on the thread by entirely avoiding the cutting impact in the thread due to the pre-stress.

This solution is also advantageous in that the most stressed component of the press in case of a cutting impact, namely the thread connection in question, is protected from the cutting impact at low cost. The thread is the first machine element that experiences the changing action of the force during a cutting impact and is thus directly exposed to the cutting impact. Subsequent components thus benefit from the elastic deformations within the thread.

In an embodiment of the present invention, a force, resulting from a weight of the stroke element and the forces acting against the compensation element or the unit, and which is controlled or regulated depending on the load changes acting in the direction of the force on the stroke element, is set in the connection arrangement.

In an embodiment of the present invention, a pre-stress and a (cutting) impact dampening as well as a compensation of the weight of the stroke element can be generated in the connection arrangement by means of a constructional unit formed by the compensation element and the unit.

In an embodiment of the present invention:

- the weight of the stroke element can be adjustably compensated for,
- the traction/pressure point can be pre-stressed along with the components located in the force flow in case of an increasing pressure or a higher adjusted pressure, and
- a pre-stress and a (cutting) impact dampening with a compensation of the weight of the stroke element can be generated in the traction/pressure element as well as in components such as the connecting rod, bolts and bearing, in case of a further increase of the force with the adjustable pressure in a first volume chamber of the unit.

In an embodiment of the present invention, the method provides for a change of the pressure adjusted in a volume chamber as a function of process data of the machine tool or the work machine, more specifically of the press.

Solutions are thus proposed which not only pre-stress said thread, but also other components. The weight of the plunger can additionally be compensated for and an impact dampening or reduction can be achieved.

The unit comprising a piston, cylinder and volume chamber can serve for pre-stressing the connection arrangement and the entire traction/pressure point, as well as for cutting impact dampening. The weight of the stroke element can be adjustably compensated for by the pressure applied in the cylinder chamber. In case of a further increase of the pressure or of a higher adjusted pressure, the traction/pressure point is additionally pre-stressed with the components located in the force flow. In case of a further increase of the force, the entire drive train, starting with the tie rod or the traction/pressure element and the other components of the drive train not otherwise specified such as the connecting rod, bolts and bearing are additionally pre-stressed. An adjustable pre-stressing of individual or all elements of the drive train with a combined weight compensation and impact dampening is thus implementable in accordance with the pressure adjusted in the volume chamber. A modification of the pre-stress pressure adjusted in the volume chamber in accordance with the gathered process data is also possible by way of corresponding measuring instruments integrated in the control and regulation system.

When the unit is dispensed with and only the compensation element with the piston and cylinder unit are instead used, the weight of the stroke element and of the traction/pressure element is compensated for and a pre-stressing of the drive train can be implemented, namely, without pre-stressing the traction/pressure point.

The combination of the individual pre-stressing, weight compensation and impact dampening functions can be implemented in the constructional unit consisting of the compensation element and unit. By varying the pressure in the volume chamber, pre-stressing individual components, compensating for the weight of components and dampening cutting impacts can be implemented together. It is possible to adjust the effectiveness to the respective operation mode of the machine by gathering process data.

In an embodiment of the present invention, the machine tool or the work machine, more specifically, comprises:

a) a machine table with a bottom tool part and a stroke element such as a plunger with an upper tool part, the stroke element such as the plunger being disposed above the machine table and being movable relative to the machine table by means of a drive device disposed in the sub-structure, a so-called bottom drive, b) a drive device for the stroke element such as a plunger with at least one traction/pressure element such as a tie rod connecting rod, connecting rod bearing and bolts or pins, which is coupled with the stroke element such as the plunger, c) at least one crankshaft to which at least one traction/pressure element such as a tie rod with a connecting rod, connecting rod bearing and bolts and pins is coupled in the connecting rod bearing, d) at least one motor for driving the crankshaft, e) a connection arrangement comprising the traction/pressure element, a traction/pressure point and a detachable connection with a connection element (4), and f) a control and regulation system, wherein a compensation element separated from the drive device and generating a force or a unit separated from the drive device and generating a force, said force generation corresponding to the weight of the traction/pressure element, is attached to the connection arrangement between the machine table and the stroke element for generating a pre-stress and a (cutting) impact dampening as well as a compensation of the weight of the stroke element.

In an embodiment of the present invention, the machine tool or work machine is affected by the compensation element adjustable in the connection arrangement with regard to a resulting force or by the unit adjustable in the connection arrangement with regard to a resulting force and according to claim 10 by the control and regulation system adjustable with regard to the resulting force depending on the load changes acting in the direction of the force on the stroke element.

In an embodiment of the present invention, the machine tool or work machine can be formed by the connection arrangement adjustable with regard to the resulting force by means of:

an active piston surface of a second piston and by means of the medium in a second volume chamber of the compensation element consisting of a second piston and a second cylinder, or an active piston surface of a first piston and by means of a medium in a first volume chamber of the unit consisting of a first piston and a first cylinder.

In an embodiment of the present invention, the compensation element or the unit can be formed as a rotary drive system.

Especially in a press, in an embodiment of the present invention, the stroke element is a plunger acting on the bottom tool part by means of the upper tool part and the compensation element or the unit are disposed in the tie rod forming the traction/pressure element, in an embodiment of the present invention, the compensation element and the unit are formed as a unit, and in an embodiment of the present invention, the compensation element or the unit are designed for guiding the stroke element formed as a plunger in an alternating direction.

The person skilled in the art can implement a control or regulation of the force acting respectively independently from the drive force of the plunger for pre-stressing the connection device and compensating the weight of the stroke element and dampening, as a function of process states of the machine tool, namely, depending on data gathered from a chronology of the course of the stroke element, or data gathered from a travel-related position of the stroke element, or the load changes acting on the stroke element in the direction of the original force.

The method is thus completed by controlling and regulating the force acting respectively independently from the drive force of the plunger during the movement of the stroke element in order to modify or stabilize a pressure to be exerted, said pressure being generated for the pre-stress in the connection arrangement, for compensation of the weight of the stroke element, and for dampening the impact of the traction/pressure element.

With this solution, it is possible to avoid the disadvantages of generic "machine tools with a stroke element" set forth in the introduction in that:

1. the different forces acting during the stroke do not affect the individual components in a disturbing way,
2. the weight/mass of the stroke element is increasingly compensated for, and
3. a comparatively "soft" touchdown of the stroke element occurs on the work piece to be machined or on the counter-tool, thus providing a mode of operation that preserves the machine and the components.

Separating the force generation of the compensation element or of the unit from the original drive force of the machine so that it is applicable as an additional force is typical of this solution.

The connection arrangement comprising the traction/pressure element advantageously comprises an area or a part for connection with the connection element, the connection being formed as a thread and the connection element being formed with a nut that is rotatable in the stroke element. The area or the part can be formed by a thread part.

The unit as well as the compensation element can respectively have or form one pre-stressable area which is realizable, for example, as a counter-thread with a pre-stressing effect.

During machining of the work piece which occurs in an alternating direction of the stroke element, the areas or flanks of the thread part forming the part always rest on corresponding areas or flanks of the connection element or thread of the nut, by means of the separate additional force.

The separate or additional force of the unit or of the compensation element must be greater than a weight of the stroke element so that the unit can, for example, act in accordance with the method against the weight with an additionally applied force which is greater than the weight of the stroke element.

The unit as well as the compensation element can be expertly formed by a spring system instead of a "piston and cylinder" configuration.

In an embodiment of the present invention, a use of the structural solution according to the method can, for example, be intended for such a press with an underfloor drive in which the drive elements, especially the tie rods, are subjected to a specific alternating force application, the tie rod, which is connected via its thread with a nut in the traction/pressure point, pulling the nut during the actual forming process.

Until now, for example, without the measures according to the present invention, the lower thread flanks on the tie rod were loaded, after which, in contrast, the plunger of the press would rest with the force of its mass on the upper thread flanks of the thread of the tie rods during the reverse stroke. Until now, said load change and impact thus occurred in that thread with each press stroke and had an adverse effect on the components and is now advantageously eliminated by the connection arrangement according to the present invention.

In a press with a bottom drive, the traction points in the thread of the nut are pulled, during the forming process, by means of the thread rod, for example, whereas during the subsequent upward movement, the thread rod then presses the plunger upwards and thus opens the tool. A load change from a "pull" during the forming process to a "push" during the opening movement thus occurs in the thread with each stroke. Without the measure according the present invention, this load change within the thread can lead to increased stress due to shocks in the thread and have a negative effect on the durability of the components.

In order to prevent this, a pre-stressing force is applied to the thread by way of the piston thus quasi pulling the plunger upwards and always loading the same thread flank during the forming process and the subsequent upward movement. A load change in the thread having an adverse effect is avoided during normal operation as well as during an occurring cutting impact. This also makes it possible, as far as the action of the force is concerned, to dispose a pneumatic cylinder on another component, which can have constructional advantages.

According to the present invention, it is achieved that an additional force is applied to the thread by way of the unit applying an additional force, for example, implemented as a piston/cylinder construction, the additional force being greater than the weight of the plunger forming the stroke element and being oriented in the opposite direction to the weight of the plunger and acting in the opposite direction to the weight of the plunger. The lower flanks of the thread are thus also moved up against the corresponding counter-flanks of the thread of the nut. The piston acting frontally on the tie rod, which is guided in the cylinder, is impinged by a medium such as pressure oil located in the volume chamber. The resulting force acting on the flanks in the thread can be adjusted via the active piston surface of the piston and the corresponding pressure in the volume chamber.

It is expedient to build up pressure in the volume chamber by way of lubricating oil already used in the machine.

As an alternative, hydraulic oil or a pneumatic or gaseous implementation can also be used.

The present invention is especially usable in such a press in which a so-called plunger weight compensation (SGA) device described in the introduction is to be used in addition to the main components (press frame, drive and press plunger). As explained in the introduction, the SGA until now only served to compensate for the weight of the plunger, but not for its mass. As a rule, pneumatic pre-stressed cylinders are installed to this end between the press frame and the plunger so that the weight of the plunger is absorbed by the SGA cylinders and so that the drive is not accelerated by the weight of the plunger during the downward movement and is not slowed down in return during the upward movement since the pressure in the SGA cylinders is adjusted so that it corresponds approximately to the weight of the plunger.

According to the present invention, the force of the SGA cylinder at the traction/pressure point is advantageously smaller than the weight of the plunger, wherein the pressure and thus the force of the SGA cylinders increases during the downward movement and the force at the bottom pressure point is greater than the weight of the plunger. This dependent force variation causes a load change in the drive elements, which is advantageous in terms of lubrication. The aim of this is that the force of the balancing cylinder is bigger than the weight of the plunger before the plunger touches down on the bottom tool and all force-transmitting parts of the drive are already slightly stressed or fitted so that when the plunger touches down on the bottom tool, there is no abrupt application of force or reversal of the direction of the force, which has an advantageous effect on the durability of the press.

With the SGA cylinder device the so-called cutting impact can also be at least partially counteracted. According to the present invention, an external plunger weight compensation device is to be mounted in presses with an underfloor drive between the press frame and the plunger as an alternative for the pre-stressed pressure points.

The compensation element is formed by said piston/cylinder unit, which is adapted to be pressurized by means of a medium, with which:

- the controllable or adjustable modification or stabilization of a pressure in the compensation element during the movement of the stroke element or plunger, and
- the increase of the pressure for reducing the penetration of the stroke element or plunger are implemented.

When the direction of the stroke element alternates, as in a reciprocating operation mode, the compensation element is adapted to be loaded by means of an alternating force, i.e., a force that stresses the components before the stroke element touches down on the bottom tool part.

These features of the solution are based on the fact that when operating modern presses with servo-motors, it can be expedient from a production optimization and energy use point of view to use discontinuous operating modes including reciprocating operating modes in addition to a continuous operating mode. The full stroke of the plunger is no longer used here. Instead, the press is respectively slowed down before reaching the upper dead center and operated downward by reversing the rotational direction. In these operating states, the motor load of the main drive can be influenced via a targeted manipulation of the pressure in the SGA (plunger weight compensation device). In an extreme case, the entire SGA cylinder device could even be dispensed with. If the SGA cylinders are dispensed with, however, the described disadvantageous load changes would occur when the plunger touches down on the bottom tool. In order to specifically protect the traction/pressure point from these abrupt and impact loaded force changes, the previously described solution, which refers, for example, to use in a press, is chosen.

The variants of the solution can functionally interact when the unit and the compensation element form one constructional unit in a press.

According to the present invention, it can be provided that when the direction of the stroke element varies, i.e., in a reciprocating operation mode, the compensation element is adapted to be loaded with an alternating force, i.e., a force that stresses the components before the stroke element touches down on the bottom tool part, wherein at least the compensation element or the unit or both elements are configured to guide the stroke element. A guiding function between the stroke element and a table accommodating a bottom tool part is thus advantageously provided.

A control/regulation system is provided for the machine tool or work machine, by means of which data:

a) which orients the additional force that is greater than the weight of the stroke element against a weight of the stroke element, and b) which guides the additionally applied force in order for at least one area of the connection arrangement that is less loaded by the original force to rest against at least one counter-area of the connection element of the connection arrangement, is processed.

The present invention is hereafter described based on an exemplary embodiment of a machine tool or work machine designed as a press with a bottom drive.

Figure 2:
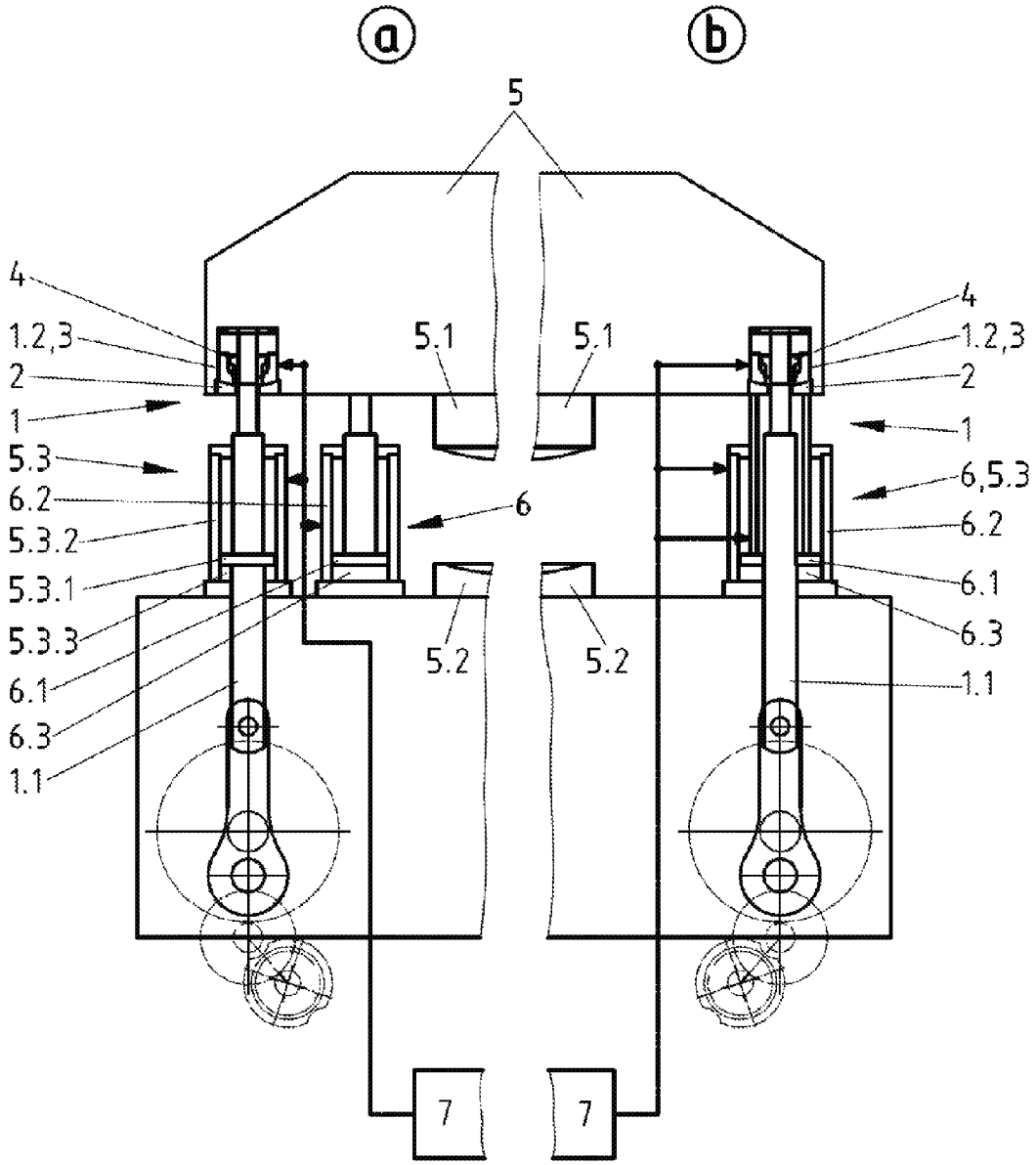
FIG. 2 shows a design schematic representation of the interaction of the compensation element 5.3 disposed in a tie rod 1.1 of the press and pre-stressing the tie rod 1.1 before the plunger 5 touches down on the bottom tool part 5.2, namely in detail a) as a variant with a compensation element 5.3 that is structurally separated from the unit 6 and detail b) as a constructional unit of the unit 6 with the compensation element 5.3.

In a press with a bottom drive (not shown as a whole) which possesses a drive device disposed in a sub-structure, FIG. 1 shows a plunger as a stroke element 5 performing a stroke, which receives an upper tool part 5.1 (according to FIG. 2), with at least one traction/pressure element 1.1, according to FIG. 2 a tie rod, engaging in one traction/pressure point 2. An upper tool part 5.1 corresponding to a bottom tool part 5.2 (see FIG. 2) disposed in a sub-structure that is not identified, is to machine or form a work piece not shown, said process being known to the person skilled in the art.

According to FIG. 1, a connection arrangement 1 according to the present invention is shown on the stroke element 5, the plunger of the press, which transmits a force in an alternating direction, substantially with at least one traction/pressure element 1.1, such as a tie rod, engaging in respectively one traction/pressure point 2 of the stroke element 5, such as a plunger, said tie rod 1.1 forming together with a connection element 4 mounted in the plunger 5 a connection 3 with the plunger 5. The tie rod 1.1 is connected to a unit 6 that is adapted to apply an additional force on the connection 3.

This unit 6 implements a basic idea of the present invention, namely to pre-stress the connection arrangement 1 or the traction/pressure point 2 by means of a force acting respectively independently from the drive force for the stroke element 5.

The tie rod 1.1 thereby has an area or a part 1.2 (see FIG. 2) for the detachable connection 3 (see FIG. 2) with the connection element 4 (see FIG. 2), the detachable connection 3 forming a thread, the connection element 4 being a nut that is rotatable in the plunger 5 and the unit 6 comprising a first piston 6.1 and a first cylinder 6.2. The first piston 6.1 is in contact with the part 1.2 so that it applies the additional force.

Thus, in the following, in a press with a bottom drive, the stroke element 5 is referred to as plunger and the traction/pressure element 1.1 as tie rod, wherein part 1.2 with the rotatable nut constitutes the detachable connection 3 with a thread. In detail, such machine elements are known to the person skilled in the art.

Based on FIG. 1, it can be seen that an alternating load is exerted by the tie rods 1.1 on the relevant traction/pressure point 2 by way of the thread 3. Thus, on the one hand, the nut 4 in the thread 3 is pulled during the forming process, whereas on the other hand, the plunger 5 loads the thread 3 in the opposite direction during the subsequent upward movement, and thus opens the tool, i.e., the upper tool part 5.1 relative to the bottom tool part 5.2 (see FIG. 2). A load change between a "pull" during the forming process and a "push" during the opening movement thus occurs in the thread 3 with each stroke. An "opening movement" is to be understood as a sequence that corresponds to a separation movement of an upper tool part 5.1 attributed to the plunger 5 (see FIG. 2) relative to a bottom tool part 5.2.

The effect of this load change within the thread 3 leading to increased stress due to shocks in the thread is now compensated for according to the present invention by applying a pre-stress force onto the thread 3 by way of the first piston 6.1, the plunger 5 being thus pulled upwards and the same thread flanks being always uniformly loaded in terms of direction during the forming process and the subsequent upward movement.

A load change in the thread 3 is thus avoided in normal operation as well as in case of an occurring cutting impact. This results in the possibility, with regard to the action of the force, of disposing the unit 6 on another component, which results in constructional advantages which are highlighted below.

The constructive features of the connection arrangement 1 are functionally combined in terms of their effect in such a way that:

- the additional force is greater than the weight of the plunger forming the stroke element 5 and is oriented opposite to a weight of the plunger,
- the flanks of the thread 3 forming the part 1.1 that are less loaded by the original force are brought to rest on corresponding flanks of the thread 3 of the nut 4 by means of the applied additional force,
- a resulting force is adjustable on the involved flanks in the thread 3 by means of the unit 6 consisting of the first piston 6.1 and a first cylinder 6.2, and the resulting force is adjustable via an active piston surface of the first piston 6.1 and by means of a liquid or gaseous medium in a first volume chamber 6.3 of the unit 6 consisting of the first piston 6.1 and the first cylinder 6.2, wherein
- the resulting adjustable force is controllable and adjustable as a function of the load changes acting on the stroke element 5 in the direction of the original force.

The exemplary embodiment is completed if the first volume chamber 6.3 is connected in a lockable manner, for example, with a medium reservoir not shown here, used for operating the machine tool, for supplying it with the medium and if medium that is already available can thus be used for operating the press.

The solution shown in FIG. 1 thus serves merely to provide that a pre-stress is applied in the thread 3, which connects the traction/pressure element 1.1 to the connection element 4, so that during the operation of the press there is no change in the direction of the force in that thread that would have an adverse effect on the durability of the thread. The pre-stress of the thread thus provided also provides an impact dampening for the load of the thread by completely avoiding a cutting impact. An advantage of this solution is that in case of a cutting impact, the most strongly stressed component of the press, namely the shown thread connection 3, is protected in a comparatively inexpensive manner against the cutting impact. In case of a cutting impact, the thread 3 is the first machine element that experiences the changing impact of the force and is thus directly exposed to the cutting impact. Subsequent components benefit from elastic deformations within the thread 3. The feature according to which the pressure adjusted in the volume chamber 6.3 can be preset depending on machine and operation parameters or can be alternatively implemented to be controllable or adjustable must be highlighted.

The measures according to the present invention cause the components, and more specifically, the thread connection, to experience, in each operational state of the press, a resulting force that has a different amount but has the same direction.

When operating the press without the pre-stressing according to the present invention, the increased impact load on the components is not the only disadvantage. The clearances that are necessary for assembly are also functionally disadvantageous, especially through the adverse effect of clearance reversal on the forming process. The clearances moreover depend on thermal influences, which are influenced by the forming process and by the environmental conditions.

This is more specifically the case with asymmetrical forming forces. Asymmetrical forming forces can be different in terms of location and occur in different heights during the downward movement of the stroke element 5 such as the plunger and thus at different points in time. These asymmetrical forces cause a corresponding asymmetrical stress to the press and the driving parts of the press.

The described measures prevent the asymmetrical forces from causing a tilting of the plunger 5 as a consequence of the clearance between the components. In fact, a tilting of the plunger 5 by a resulting adjusted force will only and exclusively occur due to elastic behavior of the involved components in accordance with Hooke's law. Pre-stressing the components according to the present invention thus not only has a positive effect on the durability of the components but also on the forming process and especially on the reproducibility of the forming process, since the amount of assembly clearances required during initial operation can change due to run-in behavior and stresses on the machine during its operating life.

According to FIG. 2, in a press with a bottom drive not specified here, the present invention is completed by constructional means. The present invention can thus have a complex implementation, namely to pre-stress the connection arrangement 1 or the traction/pressure point 2 by means of the force acting respectively independently from a drive force for the stroke element 5 (as described in FIG. 1) and to compensate for the weight of the stroke element 5, or to pre-stress the connection arrangement 1 or the traction/pressure point 2, and to compensate for the weight of the stroke element 5.

The force acting respectively independently from the drive force for the stroke element 5 is thereby greater than the weight of the stroke element 5, and in the connection arrangement 1, the resulting force is adjusted, namely controlled or regulated, depending on the load changes acting on the stroke element 5 in the direction of the force. This occurs independently from the drive force for the stroke element 5 for the acting force for a pre-stressing of the connection arrangement 1 or the traction/pressure point 2 or depending of states of process of the press.

Said dependency can furthermore be controlled or regulated based on data gathered:

- from a chronological sequence of the course of the stroke element such as a plunger 5, and
- from a travel-related position of the stroke element such as a plunger 5.

The force acting respectively independently from the drive force for the stroke element 5 is generated for modifying or maintaining a pressure to be exerted for pre-stressing the connection arrangement 1 or the traction/pressure point 2 or compensating for the weight of the stroke element 5.

According to FIG. 2, when the plunger 5 with the upper tool part 5.1 touches down on the bottom tool part 5.2, the abrupt force application or reversal of the direction of the force is eliminated with regard to its negative effect based on the basic idea according to the present invention, which is to attach a unit 6 generating an additional force to the connection arrangement 1 and to the plunger 5 acting in an alternating direction (in the construction of presses with cutting functions, this phenomenon is also customarily referred to as cutting impact by experts, although in this example it is a touch-down impact with comparably disadvantageous effects on the structural system of the press frame).

To this end, not only the unit 6 compensating at least partially for the weight of the plunger 5 with the upper tool part 5.1 but also a pre-stressing compensation element 5.3 is provided for advantageously avoiding said force application acting abruptly on the bottom tool part 5.2. In this example, it is disposed as an element of the drive train of the press in the tie rod 1.1 and pre-stresses said tie rod 1.1 before the stroke element such as the plunger touches down on the bottom tool part 5.2.

The compensation element 5.3 is here formed by a piston/cylinder unit with a second piston 5.3.1, a second cylinder 5.3.2 and a second volume chamber 5.3.3, which is pressurizable by means of a medium, wherein it fulfills:

- during the movement of the stroke element or plunger 5, a controllable or adjustable modification or stabilization of a pressure in the compensation element 5.3, and
- an increase of the pressure in the compensation element 5.3 for reducing a "penetration" by the stroke element or plunger 5.

The first volume chamber 6.3 of the unit 6 and the second volume chamber 5.3.3 of the compensation element 5.3 are connected in a lockable manner with a medium reservoir, equalizing tank, piston or tank accumulator or bladder accumulator not shown, used at least for operation of the machine tool such as the press, for supplying them with the medium.

In order to obtain the effect according to the present invention, the unit 6 and/or the compensation element 5.3 can also be formed by spring systems or rotary units.

According to FIG. 2, the compensation element 5.3 can be integrated into the tie rod 1.1 of the press as a piston/cylinder unit; however, a rotary drive system such as an air motor can also be used instead.

The compensation element 5.3 is adapted to be loaded when the plunger 5 changes its direction in a reciprocating operation mode, i.e., with a force that pre-stresses the components before the plunger 5 touches down on the bottom tool part 5.2.

FIG. 2 shows two embodiments with details a) and b) according to the present invention, which satisfy the implementation of the method.

In the variant of FIG. 2 *a*), the unit 6 and the compensation element 5.3 are disposed as separate constructional units, wherein:

- the unit 6 alone implements the function of a unit 6 generating an additional force, and
- the compensation element 5.3 alone forms the pre-stressing compensation element (5.3).

Said constructional units can thus be controlled independently from each other.

In the variant of FIG. 2 *b*), the unit 6 and the compensation element 5.3 are designed as an integrated assembly group, the function of the unit 6 and the function of the compensation element 5.3 being coupled with each other in such a manner that a common control with individually implementable operational steps can be implemented, i.e., the effects described above, such as the generation of an additional force and the impact preventing effect of pre-stressing. This variant of FIG. 2 *b*) also makes it possible to provide greater machining spaces in forming presses (for example for bulky work pieces), thus supporting the unobstructed operation of the press.

It can be gathered from FIGS. 1 and 2, for example, that:

- in the embodiment according to FIG. 1, the unit 6 pre-stresses the traction/pressure point 2, wherein the weight of the stroke element 5 is not yet being compensated for;
- in the embodiment according to FIG. 2 *a*), the unit 6 pre-stresses the traction/pressure point 2 and the entire connection arrangement 1 including, for example, a gear transmission not shown here of the original drive;
- in the embodiment according to FIG. 2 *b*), the functions of the unit 6 and of the compensation element 5.3 are brought together in a space-saving construction unit.

In order to carry out the functions according to the present invention, a control/regulation system 7 is integrated into a respective process program, by means of which, data:

a) which orients the additional force that is greater than the weight of the stroke element against a weight of the stroke element, and b) which guides the additionally applied force in order for at least one area of the connection arrangement that is less loaded by the original force to rest against at least one counter-area of the connection element of the connection arrangement, is processed and input.

For the press, the control/regulation system 7 can at least process and input data:

- which serves to adjust the resulting force of the unit 6 or of the compensation element 5.3,
- which has been gathered from the process or the status of the press for the controllable or adjustable connection arrangement,
- which has been gathered from the chronological sequences of the course of the stroke element such as the plunger 5 for which data the controllable or adjustable connection arrangement 1,
- which has been gathered from the travel-related position of the stroke element such as the plunger 5 for which data the controllable or adjustable connection arrangement 1,
- which has been gathered depending on the load changes acting on the stroke element such as the plunger 5 in the direction of the original force, or from the first volume chamber 6.3 and the second volume chamber 5.3.3.

FIG. 2 *a*) and *b*) thus show constructional solutions which not only pre-stress said thread 3 but also other components. As another function, the weight of the plunger is compensated for and an impact dampening or impact reduction is achieved. In FIG. 2 *a*), the unit 6 consisting of a piston, cylinder and volume chamber serves to pre-stress the connection arrangement and the entire pressure point or traction point and for cutting impact dampening. The weight of the stroke element 5 can be compensated for in an adjustable manner by way of the pressure applied in the cylinder chamber 6.3. When the pressure continues to increase or has been adjusted higher, the pressure/traction point 2 is additionally pre-stressed with the parts located in the force flow. When the pressure continues to increase, the entire drive train 1.1, starting with the tie rod or the traction/pressure element as well as the other components of the drive train not specified such as the connecting rod, bolts, bearing or the tie rod with a connecting rod, connecting rod bearing and bolts or pins, is pre-stressed. An adjustable pre-stress of individual or all elements of the drive train with a combined weight compensation and impact dampening is thus implementable in accordance with the adjusted pressure in the volume chamber. By means of corresponding measuring instruments which are integrated in the control and regulation system 7, a modification of the pre-stress pressure adjusted in the volume chamber 6.3 is also possible in accordance with the gathered process data. When dispensing with the unit 6 according to the arrangement of FIG. 2 *a*), and using only an arrangement corresponding to the compensation element 5.3 with a piston and cylinder unit, the weight of the stroke element and of the traction/pressure element is compensated for and a pre-stressing of the drive train can be implemented without pre-stressing the traction/pressure point.

The solution shown in FIG. 2 *b*) provides a constructional combination of the individual pre-stressing, weight compensation and impact dampening functions. By way of a variation of the pressure in a volume chamber 6.3, implementing a common pre-stressing of individual components, a weight compensation of components and a cutting impact dampening is achieved. It is here also possible to determine the effectiveness on the respective operation mode of the machine by gathering process data.

The connection arrangement 1 developed according to the present invention for a machine tool or a work machine such as a press is structurally and technologically implementable with the indicated technical means and can advantageously increase the use value of respective machine tools or work machines, more specifically of generic presses.

The present invention is not limited to embodiments described herein; reference should be had to the appended claims.

LIST OF REFERENCE NUMBERS

1 connection arrangement
1.1 traction/pressure element, tie rod, drive train
1.2 area or part of the traction/pressure element, thread part
2 traction/pressure point
3 detachable connection, thread
4 connection element, rotatable nut
5 stroke element, plunger

5.1 upper tool part
5.2 bottom tool part
5.3 compensation element, piston/cylinder unit
5.3.1 second piston
5.3.2 second cylinder
5.3.3 volume chamber
6 unit
6.1 first piston
6.2 first cylinder
6.3 first volume chamber
7 control/regulation system

What is claimed is:

1. A method for operating a machine tool or a work machine, the method comprising:

providing a machine tool or a work tool comprising:

a stroke element, a connection arrangement comprising:

a traction/pressure element, and at least one traction/pressure point, a detachable connection comprising a connection element, a sub-structure comprising a drive device configured as a bottom drive, and a compensation element or a unit, wherein the compensation element or the unit is configured to generate a pre-stress, an impact dampening, and to compensate for a weight of the stroke element in the connection arrangement, configuring the drive device to act directly or indirectly on a work piece to be machined via the connection arrangement with the traction/pressure element and the at least one traction/pressure point via the stroke element; and producing a force via the compensation element or the unit corresponding to a weight of the traction/pressure element, the force being initiated independently from a drive force for the stroke element, so as to generate a pre-stress, an impact dampening and a compensation of the weight of the stroke element in the connection arrangement.

2. The method as recited in claim 1, wherein at least one of:

the machine tool or the work machine is a press, the traction/pressure element is a tie rod, and the stroke element is a plunger.

3. The method according as recited in claim 2, wherein the detachable connection is a thread and the connection element is a rotatable nut, and the pre-stress and the impact dampening is generated by the unit in the traction/pressure point and by the detachable connection with the connection element so that the thread is pre-stressed so as to be shock-free.

4. The method as recited in claim 3, further comprising:

adjusting a resulting force from the weight of the stroke element and forces acting against the compensation element or the unit in the connection arrangement.

5. The method as recited in claim 4, further comprising:

controlling or regulating the resulting force depending on load changes acting on the stroke element in a direction of the force.

6. The method as recited in claim 5, wherein the compensation element and the unit together form a constructional unit, and the pre-stress, the impact dampening, and the compensation of the weight of the stroke element is generated in the connection arrangement via the constructional unit.

7. The method as recited in claim 6, wherein the unit of the machine tool or the work machine further comprises a first volume chamber configured to provide for an adjustable pressure in the connection arrangement, wherein, via the adjustable pressure in the first volume chamber, the method further comprises:

adjustably compensating for the weight of the stroke element;

pre-stressing the traction/pressure point and parts located in a force flow when a pressure increase or of a higher adjusted pressure occurs; and generating the pre-stress, the impact dampening, and the compensation of the weight of the stroke element in the traction/pressure element and in other components when a further increase of the force occurs.

8. The method as recited in claim 7, wherein the other components include a connecting rod, a bolt and a bearing.

9. The method as recited in claim 7, further comprising:

modifying a pressure adjusted in the volume chamber as a function of process data of the machine tool or of the work machine.

* * * * *